United States Patent [19]

Lee, Jr.

[11] Patent Number: 4,649,581

[45] Date of Patent: Mar. 17, 1987

[54] PATIENT LIFT ASSEMBLY

[76] Inventor: John P. Lee, Jr., 814 High St., Willow Springs, Ill. 60480

[21] Appl. No.: 682,191

[22] Filed: Dec. 12, 1984

[51] Int. Cl.[4] ..... A61G 7/10

[52] U.S. Cl. ..... 5/81 B; 5/65; 5/86; 5/89; 414/458

[58] Field of Search ..... 5/81 R, 81 B, 83, 86, 5/63, 64, 65, 89; 414/458, 589

[56] References Cited

U.S. PATENT DOCUMENTS

| | | | |
|---|---|---|---|
| 1,597,962 | 8/1926 | Foy | 5/81 R |
| 2,498,853 | 2/1950 | Hassold et al. | 5/86 |
| 2,539,346 | 1/1951 | Frist | 5/86 |
| 2,903,238 | 9/1959 | Flandrick | 5/86 |
| 3,959,832 | 6/1976 | Parsons | 5/81 R |
| 4,103,883 | 8/1978 | Shepherd | 269/289 MR |

*Primary Examiner*—Alexander Grosz
*Attorney, Agent, or Firm*—Kirkland & Ellis

[57] ABSTRACT

A patient lift assembly is provided in which a patient supported on a sheet of flexible, durable material is elevated by increasing the horizontal distance between elevated horizontal arms to which the sheet is removably attached. The horizontal distance between the arms is increased by increasing the distance between the base leg connectors of the apparatus which, in turn, separates the uprights to which the arms are attached. The patient is lowered by decreasing the distance between the arms and increasing the slack in the sheet.

12 Claims, 9 Drawing Figures

PATIENT LIFT ASSEMBLY

BACKGROUND OF THE INVENTION

1. Field of Invention

The present invention is an apparatus for elevating and transporting patients who are unable to move under their own power, which invention is of adjustable height, width, and length and is easily assembled for use and disassembled for storage or transport.

2. Description of the Prior Art

Patient lifts of various types are known in the prior art. Disadvantages of the prior art lifts include patient discomfort in the positioning of the apparatus, difficulty in assembling and disassembling the apparatus, and the expense of manufacturing the apparatus. To elevate the patient, prior art patient lifts use an overhead metal bar attached to an elevated lift arm. The metal bar is connected on each end to chains which in turn are connected to a chair or a sling supported by a stretcher frame in which the patient is positioned. The lift arm, and thus the patient, is raised and lowered by a hydraulic jack. The disadvantage of using the overhead means of the prior art is that access to the patient is limited.

The present apparatus makes use of a sheet of durable, flexible material to support and lift the patient instead of a rigid platform or a sling mounted to a rigid stretcher frame. The use of the sheet of flexible material instead of a rigid platform or sling mounted to a rigid stretcher frame as in the prior art allows the material to be placed on the patient's bed before the patient himself is placed there and to remain on the bed without interferring with patient access or comfort. This eliminates the need to reposition the patient when it is necessary to raise him off the bed and transport him. Furthermore, this advanced placement of the material reduces physical strain on the nurse or other person who would otherwise have to lift the patient onto another bed or stretcher to be transported. The present invention also minimizes patient discomfort by allowing the patient to be easily raised and moved from one portion of the bed to another without causing discomfort to the patient or physical strain on the nurse. In addition, the present invention utilizes structure for lifting the patient which increases access to the patient.

SUMMARY

The present invention is used to provide a patient lift which is comfortable, adjustable, easily assembled and disassembled, and which can be placed in position long before a patient must be moved. The patient lift of the present invention comprises a flexible patient support herein depicted as a sheet of strong, durable fabric made of polyester, nylon or other suitable material. The patient support fabric is attached to a framework of rigid, but adjustable, horizontal and vertical support members (i.e., base leg connectors, base legs, uprights and arms). It is maintained in the assembled position by removable pins between the base leg connectors and base legs, by an angle brace between the base leg connectors and the uprights, by removable pins between the uprights and the arms, and by loops between either end of the patient support sheet and the arms. The arms, base leg connectors, and base legs are each adjustable in length to accommodate patient support sheets of various widths. In addition, the height of the arms also can be varied to adjust the range of heights within which the patient can be raised and lowered. The base leg connectors are connected by a rigid rod which is attached to one base leg connector; the rod is telescoped into tubing which is attached to the other base leg connector. The present invention is constructed so that by increasing the distance between the base leg connectors on either end, the distance between the arms to which the sheet is attached is also increased. This, in turn, removes slack from the sheet and raises the patient. A jack is connected to one base leg connector to provide means for adjusting the distance between the base legs and the base leg connectors on the two ends of the patient lift. This causes the rigid rod to be withdrawn from the tubing, thereby causing the slack to be taken up in the patient support sheet and raising the patient or other object thereon, or inserted into the tubing, thereby increasing the slack in the patient support sheet and lowering the patient or other object thereon. The slack in the sheet is increased and patient is lowered by the action of three springs, connected to the base leg connectors alongside the rigid rod and tubing, which pull the base leg connectors of the patient lift toward each other horizontally as the tension of the jack is gradually released. Attached to the base legs are coaster wheels so that the lift and a patient being supported by it can be easily transported. Straps for securing the patient while being raised and transported are attached to the patient support sheet.

Thus, it is a principal object of the present invention to provide means for raising and transporting patients which can be positioned on a hospital bed before the patient is placed on the bed, thereby allowing for greater patient comfort when the patient must be moved by eliminating the need to reposition the patient on a separate, transportable stretcher or bed.

Another object of the present invention is to provide a patient lift which minimizes the physical effort of the person transporting the patient.

Another object of the present invention is to provide a patient lift which facilitates access to the patient by minimizing the structure that extends over and around the patient.

Another object of the present invention is to provide a patient lift that is adjustable in length, width and height.

Another object of the present invention is to provide a patient lift which can be disassembled easily for storage or transport and assembled for use.

These and other objects, advantages, and features shall hereinafter appear, and for purposes of illustration, but not for limitation, an exemplary embodiment of the present invention is illustrated in the accompanying drawings.

BRIEF DESCRIPTION OF THE DRAWINGS

1.

8.

DETAILED DESCRIPTION OF PREFERRED EMBODIMENT OF THE INVENTION

Figure 1:
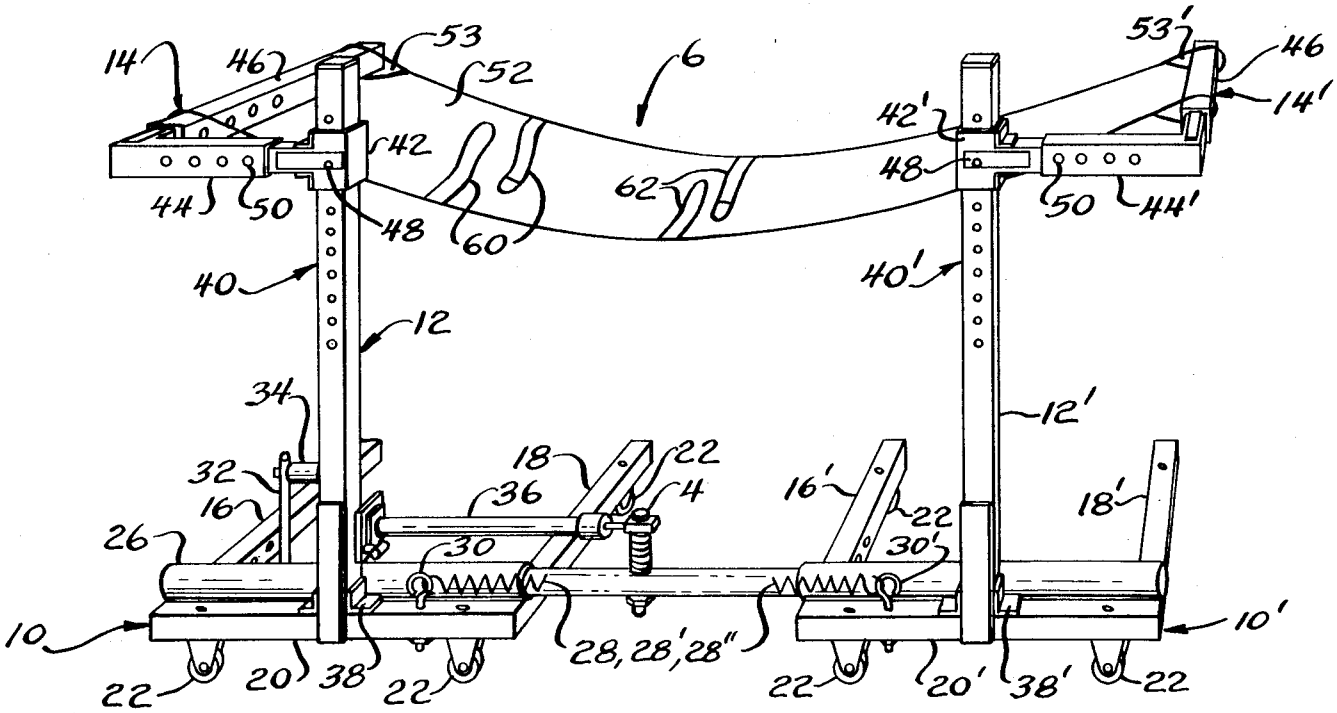
FIG. 1 is a perspective view of the preferred embodiment of the patient lift frame of the present invention;
2.

FIG. 1 is a perspective view of the patient lift frame 6 of the present invention. Except for the jack 36, the left and right sides of the patient lift frame 6 are mirror images, hence in the following description, only the left side will be described in detail. The numbers which correspond to the lefthand members of the apparatus will be designated as "no." and the righthand mirror-image members as "no.'" so as to facilitate the description of the preferred embodiment.

Figure 5:
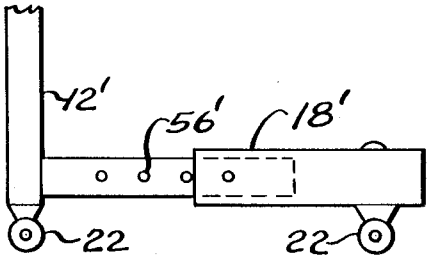
FIG. 5 is a right side view of the extended position of the base leg of the patient lift frame;
6.

The left side of the patient lift frame 6 comprises horizontal base 10, vertical upright 12, and elevated horizontal support member 14. The horizontal base 10 has two base legs 16 and 18 connected by a base leg connector 20. The base leg connector 20 is U-shaped and adapted for attachment of base legs 16 and 18, respectively, to either end, as described hereinafter. The far left base leg 16 is removably attached to one end of the base leg connector 20 by suitable fasteners (not shown), while the left base leg 18 is similarly removably attached to the other end of base leg connector 20. In the preferred embodiment, base legs 16 and 18 can be hollow on the end that attaches to base leg connector 20 and adapted to slide over the base leg connector 20 and secured in position by a suitable fastener, such as pin 56' as illustrated schematically in FIG. 5. As further illustrated in FIG. 5, the length of each of the base legs 16 and 18 can be adjusted by one end being adapted to be telescoped into the other. Suitable coaster wheels 22 support base legs 16 and 18 and each end of connector 20.

The left horizontal base 10 is attached to the right horizontal base 10' by a rigid rod 24 which extends between them. Rod 24 is rigidly attached to horizontal base 10 and can be adapted to telescope into a tube member 26 that is rigidly attached to horizontal base 10'. Withdrawing rod 24 from the tube member 26 extends the distance between horizontal bases 10 and 10'. Means, herein depicted as a bolt and nut assembly 4, are provided for fixing the position of rod 24 with respect to tube member 26, thereby maintaining the desired distance between the horizontal bases 10 and 10'. It should be understood that rod 24 and tube member 26 could be replaced with two or more such rods and tubes or members having other configurations without departing from the scope of this invention. Parallel to the rigid rod 24 and tube member 26 is a suitable spring assembly 28 shown schematically, with the left end of spring assembly 28 being attached to left base leg connector 20 by suitable means such as an eyebolt 30 and the right end of spring assembly 28 being similarly attached to right base leg connector 20' by right eyebolt 30'. In the embodiment illustrated in the drawings, a manual jack 36 is used for increasing the distance between horizontal bases 10 and 10'. Other suitable means, such as a motor and gear assembly or hydraulic jack also could be used. In the embodiment illustrated, jack 36 is manually operated by a jack handle 32, which can be stored by removably attaching it to left upright 12, by a magnet or suitable bracket (not shown).

Figure 4:
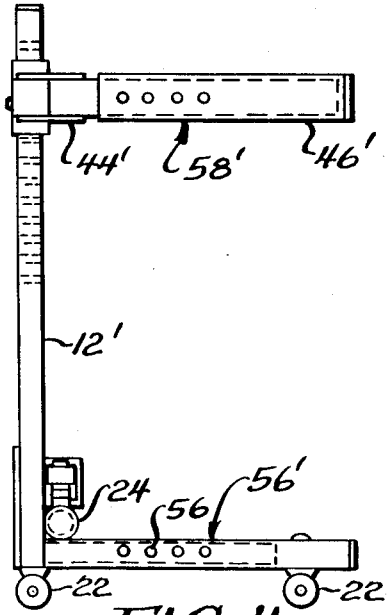
FIG. 4 is a right side view of the patient lift frame;
5.

The left side of the patient lift frame has a vertical member or left upright 12, which is attached to left base leg connector 20 by suitable means such as a bracket 38. Left upright 12 has a portion with holes 40. An elevated horizontal support member, left arm 14, as described hereinafter, is removably attached to upright 12. Arm 14 consists of an arm connector 42, an arm base 44, and an arm member 46. Arm connector 42 is configured to slide up and down along the portion of upright 12 having holes 40. Left arm connector 42 is removably attached to left upright 12 by any suitable means such as a pin 8 which is inserted through a hole 48 in arm connector 42 and one of the holes 40 in left upright 12 thereby holding arm 14 at the desired height. Arm connector 42 extends horizontally out from upright 12 in a direction substantially perpendicular to the axis of rod 24. Arm connector 42 is removably attached to arm base 44 by a pin 8 inserted through one of a plurality of holes 50 in arm connector 42 which is aligned with one of a plurality of holes 51 in arm base 44. These holes allow the distance between arm members 46 and 46' to be adjusted by insertion pin 8 into appropriate holes 50 and 51. See FIGS. 2–4. In the preferred embodiment, arm connector 42, arm base 44 and arm member 46 are configured so that base 44 extends substantially perpendicular to arm member 46. Arm base 44 and arm member 46 are adapted to slide onto arm connector 42 and arm base 44, respectively.

Figure 7:
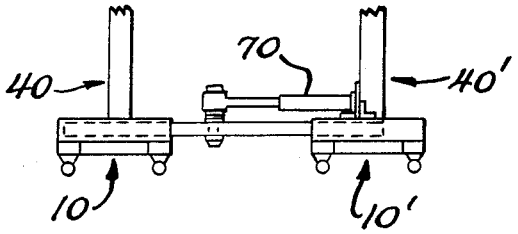
FIG. 7 is a schematic side view of the hydraulic motor used in one embodiment of the present invention.

When rod 24 is withdrawn from tube member 26 by operation of jack 36 to increase the distance between the horizontal bases 10 and 10', the spring assembly 28 stretches so as to provide a bias force pushing horizontal bases 10 and 10' toward each other, which bias increases as the distance therebetween is increased. As illustrated schematically in FIG. 7, an hydraulic motor 70 or other suitable type of motor driven mechanism can be used to increase the distance between bases 10 and 10' and thereby raise patient support member 52. As horizontal bases 10 and 10' are moved apart by jack 36, the distance between arms 14 and 14' increases correspondingly. When one end of a patient support sheet 52 (see FIG. 2) is attached to arm 14 and the other end to arm 14', the increased distance between the arms causes the sheet to become more taut, thus raising the patient. When jack 36 is released, the bias of the spring assembly 28 pulls the horizontal bases 10 and 10' together by telescoping rod 24 into tube member 26. The decrease in distance between the horizontal bases 10 and 10' causes a corresponding decrease in distance between uprights 12 and 12' and between arms 14 and 14'. The decrease in distance between the arms 14 and 14' increases the slack in patient support member 52, thereby causing the patient thereon to be lowered.

Figure 2:
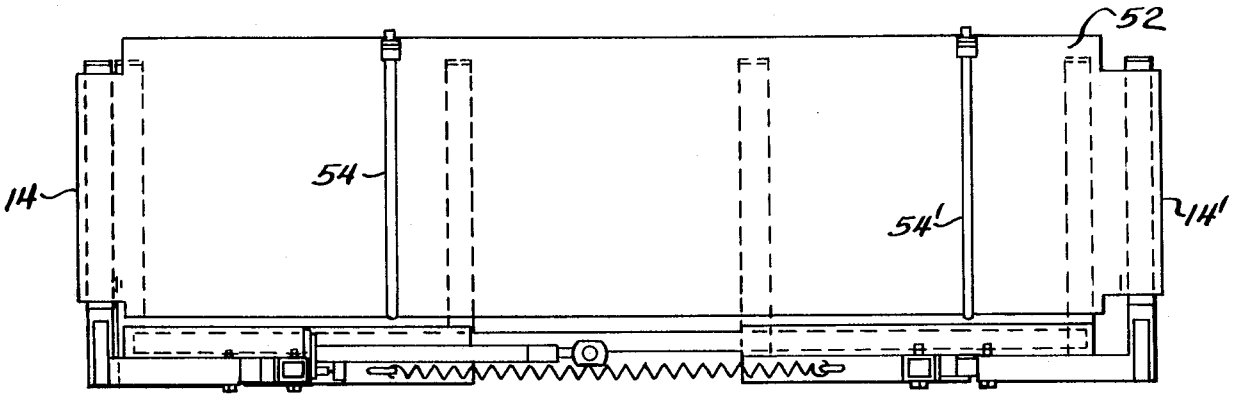
FIG. 2 is a top view of the preferred embodiment of the patient lift apparatus;
3.
Figure 3:
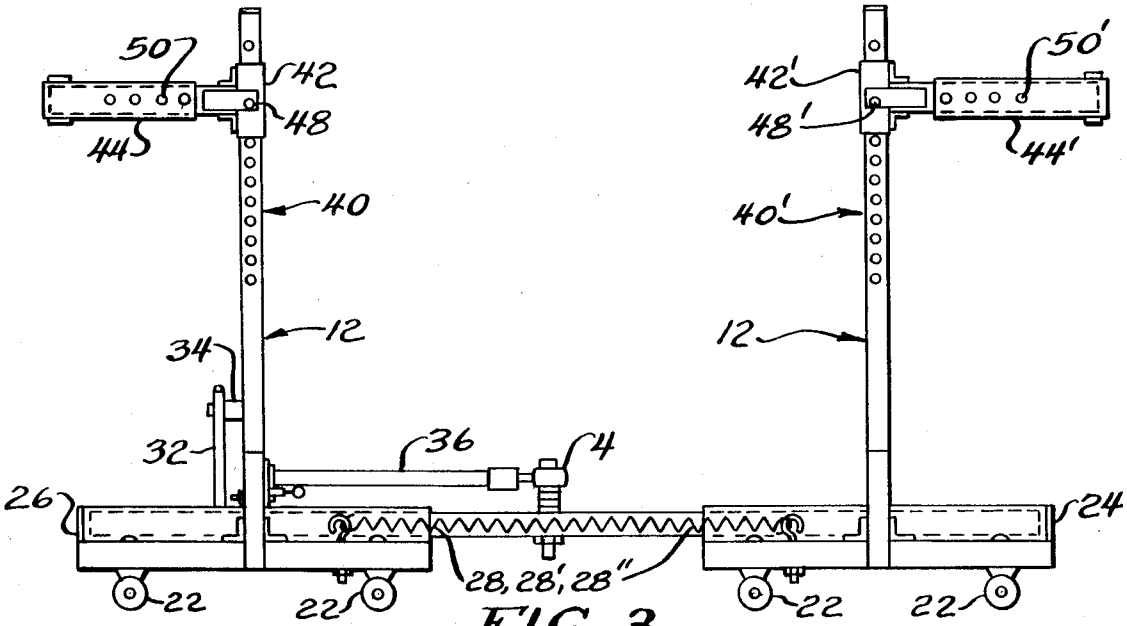
FIG. 3 is a front view of the patient lift frame;
4.
Figure 6:
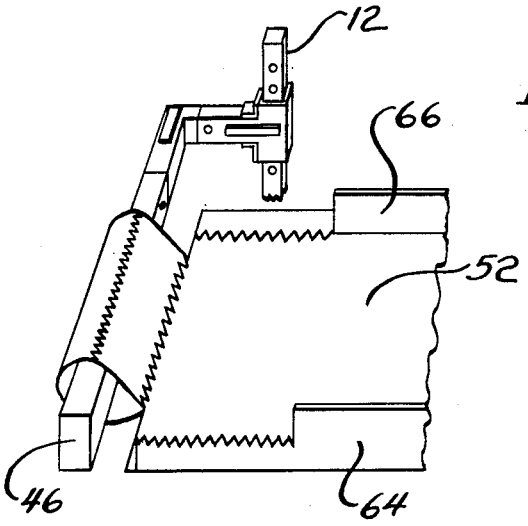
FIG. 6 is a partial section view of the flexible patient support member used in the present invention; and
7.
Figure 8:
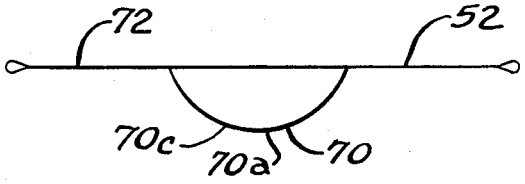
FIG. 8 is a schematic side view of another embodiment of the patient support member of the present invention adapted to hold patients in a sitting position. 8*a* FIG. 8*a* is a schematic plan view of the embodiment of the patient support member of FIG. 8.
Figure 8A:
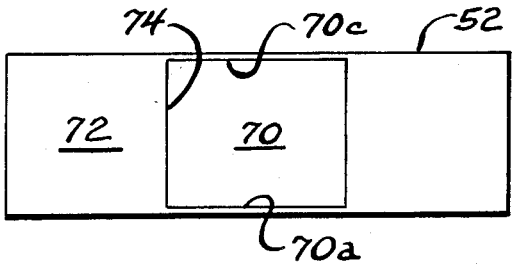

FIG. 2 shows a top view of the patient lift apparatus 6, including patient support member 52. One end of support member 52 is attached to arm 14 by sliding a loop 53 (see FIG. 1) on the end of support member 52 over arm 14. The other end of support member 52 is attached to arm 14' by loop 53' in a similar fashion. In the preferred embodiment, patient support member 52 includes suitable straps 54, 54' for securing the patient or other object onto support member 52. As illustrated in FIGS. 2 and 6, respectively, patient support member 52 also may include straps 60, 62 or left and right side members 64, 66 for preventing the patient from sliding off either side thereof. FIG. 8 illustrates an alternative embodiment of patient support member 52 that is adapted to support patients in a sitting position. Support member 52 preferrably is placed under the patient to be moved before support member 52 is attached to the patient lift by sliding the loops on the ends of support member 52 over arms 14 and 14'. In an alternative embodiment, support member 52 is configured such that, when stretched taut with the ends substantially horizontal, it includes a lower section 70 suspended from a higher section 72 as illustrated schematically in FIGS. 8 and 8*a*. For example, a patient can sit on lower section 70 with his or her head and shoulders protruding through opening 74 in upper section 72 and with his or her feet hanging over edge 70*a* or 70*c* (depending upon the direction the patient is facing) of lower section 70. Patient lift apparatus 6 is readily transported while supporting a patient by means of wheels 22.

While the preferred embodiment of the invention has been illustrated and described, it is to be understood that the invention is not to be limited to the precise construction herein disclosed, and the right is reserved to all changes and modifications coming within the scope of the invention as defined in the appended claims.

I claim:

1. A patient lift apparatus for raising and lowering incapacitated persons or inanimate objects comprising:

first and second base members;

connecting means for adjustably connecting together said first and second base members so that the distance therebetween can be increased or decreased;

first and second frame members mounted on said first and second base members, respectively, said first and second frame members extending vertically above said first and second base members;

flexible patient support means for supporting the patient, and support means being placed beneath the patient and the first and second opposite ends of said support means being attached to said first and second frame members, respectively, whereby the height of said support means is affected by the amount of slack therein, and the amount of slack is affected by the distance between said first and second base members; and spring means for biasing said first and second base members toward one another; and motor means for increasing the distance between said first and second base members thereby overcoming the bias of said spring means and lifting said patient support means.

2. The apparatus as claimed in claim 1 further comprising roller means for rollably supporting said first and second base members, thereby facilitating adjustment of the distance between said first and second base members and transport of the patient lift apparatus.

3. The apparatus as claimed in claim 1 wherein said first and second frame members further comprise height adjustment means for adjusting the height of said first and second frame members.

4. The apparatus as claimed in claim 1 wherein each of said first and second frame members further comprises:

a vertical stand member having a plurality of horizontal holes therethrough;

a horizontal arm for attaching to one end of said flexible support member, said arm being configured for vertical sliding engagement with said stand member; and fastener means for insertion into any selected one of the holes in said stand member thereby supporting said arm on said stand member at a selected height.

5. The apparatus as claimed in claim 4 wherein said flexible patient support means further comprises loop means on the first and second ends thereof, whereby said flexible patient support means is attached to said first and second frame members by sliding each of said loop means over one of said horizontal arms.

6. The apparatus as claimed in claim 1 wherein said flexible patient support means is comprised of a continuous material.

7. The apparatus as claimed in claim 1 wherein said flexible patient support means is comprised of a discontinuous material.

8. The apparatus as claimed in claim 1 wherein said flexible patient support means further comprises left and right side members for preventing the patient from sliding off either side while being supported on said flexible patient support means.

9. The apparatus as claimed in claim 1 wherein said flexible patient support means is configured such that when stretched taut with the ends substantially horizontal it includes first and second sections, said first section being at a lower elevation than said second section, whereby the patient can assume a sitting position on said first section.

10. The apparatus as claimed in claim 1 wherein said motor means further comprises:

manually operable jack means for increasing the distance between said first and second base members.

11. The apparatus as claimed in claim 1 wherein said connecting means further comprises locking means for securing said first and second base members a fixed distance apart.

12. The apparatus as claimed in claim 1 wherein said connecting means further comprises a first telescoping member rigidly attached to said first base member and a second telescoping member rigidly attached to said second base member, wherein said first telescoping member telescopes into and out of said second telescoping member to decrease and increase, respectively, the distance between said first and second base members.

* * * * *